US005997405A

United States Patent [19]

Russell et al.

[11] Patent Number: 5,997,405

[45] Date of Patent: Dec. 7, 1999

[54] GOLF PRACTICE DEVICE

[76] Inventors: Neil William Russell, Aberdarc Hotel, 29 Cessnock Road, Weston, NSW 2326; John Maurice Dunphy, Unit 1, 1-13 Endeavour Road, Caringbah, NSW 2229, both of Australia; Wai Sang Lam, 2/F., No. 186 Sheung Wo Che, Shatin, New Territories, The Hong Kong Special Administrative Region of the People's Republic of China

[21] Appl. No.: 08/866,436

[22] Filed: May 30, 1997

[30] Foreign Application Priority Data

Aug. 5, 1996 [GB] United Kingdom ..... 9616470

[51] Int. Cl.[6] ..... A63B 69/36

[52] U.S. Cl. ..... 473/140; 473/146; 473/149

[58] Field of Search ..... 473/138, 139, 473/140, 143, 146, 147, 149; 40/327

[56] References Cited

U.S. PATENT DOCUMENTS

| | | | |
|---|---|---|---|
| D. 248,685 | 7/1978 | Brown | D34/15 PP |
| D. 340,964 | 11/1993 | Dunphy | D21/234 |
| D. 349,937 | 8/1994 | Hill | D21/234 |
| 1,579,294 | 4/1926 | Fisk | 473/147 |
| 1,690,158 | 11/1928 | Currie | 473/146 |
| 1,795,732 | 3/1931 | Miller | 40/327 |
| 1,804,040 | 5/1931 | Tannehill . | |
| 1,976,405 | 10/1934 | Le Witt | 473/146 |
| 2,510,266 | 6/1950 | Taylor | 473/149 |
| 2,529,771 | 11/1950 | Herman | 273/35 |
| 2,839,853 | 6/1958 | Giangreco | 40/327 |
| 3,383,921 | 5/1968 | Palmer . | |
| 3,452,990 | 7/1969 | Nichols . | |
| 3,731,926 | 5/1973 | Vincent . | |
| 3,815,922 | 6/1974 | Brainard . | |
| 4,014,552 | 3/1977 | Watson . | |
| 4,014,553 | 3/1977 | Sakamoto . | |
| 4,023,809 | 5/1977 | Newton . | |
| 4,092,027 | 5/1978 | Carter . | |
| 4,113,257 | 9/1978 | Moffatt . | |
| 4,120,502 | 10/1978 | Martin . | |
| 4,125,230 | 11/1978 | Fischer . | |
| 4,139,197 | 2/1979 | Windall . | |
| 4,429,880 | 2/1984 | Chen et al. | 273/176 FA |
| 4,496,156 | 1/1985 | Centafanti . | |
| 4,573,687 | 3/1986 | Nilsson . | |
| 4,609,197 | 9/1986 | Vodin . | |
| 4,655,460 | 4/1987 | Hambright . | |
| 4,660,835 | 4/1987 | Locurto | 473/147 |
| 4,662,461 | 5/1987 | Peyret, Jr. . | |
| 4,662,639 | 5/1987 | Bonotto . | |
| 4,861,035 | 8/1989 | Page . | |
| 4,927,154 | 5/1990 | Boyer et al. . | |
| 4,936,584 | 6/1990 | Ewald et al. . | |
| 4,958,836 | 9/1990 | Onozuka et al. | 273/184 R |
| 4,971,326 | 11/1990 | Montone . | |
| 5,035,432 | 7/1991 | Lew . | |
| 5,054,786 | 10/1991 | Solomon . | |
| 5,056,790 | 10/1991 | Russell | 273/184 B |
| 5,108,107 | 4/1992 | Shelton et al. . | |
| 5,121,923 | 6/1992 | D'Allura . | |
| 5,178,393 | 1/1993 | Dennesen . | |
| 5,255,920 | 10/1993 | Mangeri . | |
| 5,286,028 | 2/1994 | Daugard . | |
| 5,513,847 | 5/1996 | Hu et al. | 473/149 |

*Primary Examiner*—Steven Wong
*Attorney, Agent, or Firm*—Jenkens & Gilchrist, P.C.

[57] ABSTRACT

A golf practice device having a base supporting a substantially vertical fixed shaft which supports a wheel mounted for rotation about the shaft, and a ball tethered by at least one flexible cord to the wheel. The device also includes an optical sensor which is disposed adjacent to the wheel to detect the rotation thereof and to output a signal indicative of the rate of rotation. This signal is sent to a processor which calculates the free distance of travel a real untethered ball would have traveled and outputs a signal to a display to indicate the free distance of travel to a user.

12 Claims, 7 Drawing Sheets

GOLF PRACTICE DEVICE

BACKGROUND OF THE INVENTION

The game of golf is becoming ever more popular around the world. It is not always possible for a golfer to have access to a golf course or driving range, and there exists a need for a device which allows a golfer to practice driving of golf balls in their own home, office or other convenient location as and when it suits them.

Quite a variety of existing golf practice devices are available. In general, these have a golf ball or simulated golf ball tethered to some kind of anchor. One such device in which the ball is connected to an anchor by means of an elasticated cord is disclosed in U.S. Pat. No. 4,660,835. A more sophisticated type of device, is shown in U.S. Pat. No. 4,429,880 which shows a golf ball which is mounted on a joystick arrangement, where sensors are arranged to transmit data concerning the movement of the joystick as it is struck to a computer. The computer makes a calculation of the distance the ball would have travelled if it was a normal free golf ball based on the detected movement of the joystick.

Other prior devices include a simulated ball mounted on a rigid rod. Sensors placed on the rod measure the movement of this as the ball is struck. One such device is shown in U.S. Pat. No. 4,958,836.

There are various problems with the existing devices. For those where the ball is mounted on a rigid rod there is the significant drawback that the ball does not have the feel of a normal free ball. When the ball is not struck absolutely squarely, a lateral force is transmitted to the device, whereby the ball does not react as a free ball would. As well as feeling unnatural such lateral forces cause eventual damage to the device.

Many of the prior art devices are very large and complicated, requiring a special platform, computing equipment and display device, such that they are appropriate only for commercial use.

The present invention seeks to provide an improved golf practice device which is simple to use, and can be used even inside the home if desired, and yet still gives the feel of a free golf ball.

SUMMARY OF THE INVENTION

According to the present invention there is provided a golf practice device comprising:

a base supporting a substantially vertical fixed shaft;

a wheel mounted for rotation about the shaft;

a ball tethered by at least one flexible cord to the wheel;

sensing means disposed adjacent the wheel to detect the rotation thereof and output a signal representative of the rotation;

processing means adapted to process said signal and to output a signal representative of a free distance of travel of the ball; and display means to display said distance to a user.

Use of a ball tethered by a flexible cord and which rotates about a vertical axis results in an arrangement which closely approximates the feel of striking a real "free" golf ball.

Preferably, the wheel is mounted on the shaft by means of a rolling bearing. This ensures minimal friction acts against the rotation of the ball, increasing accuracy of velocity measurement, as well as enhancing the free feel of the ball.

The ball is preferably tethered to the wheel by means of a pair of cords. The use of two cords serves as a safety feature since the ball will still be tethered even if one cord breaks. The cords are preferably of substantially identical length.

In the preferred embodiment the wheel includes a photo-interrupter in the form of a ring comprising a large number of upstanding generally axially-extending fingers, said sensor comprising an opposed photo-transmitter and receiver arranged on opposite sides of the ring. This structure allows an accurate measurement of velocity to be made. The ring is provided with a solid fingerless arcuate region, over which region no singals are generated by said sensor as this region moves through the sensor. The arcuate region extends through an angle about 10 degrees, and in the position in which the ball is struck blocks the sensor. This allows measurement of velocity to be commenced only after the ball has undergone a degree of rotation so that no measurement is made of the period during which the ball is in contact with the club head over which the ball is still accelerating.

The ball is preferably a solid sphere of polyurethane. Such a ball closely approximates a real golf ball. The golf ball may include at least one wear indicator in the form of at least one small recess in the surface of the ball. The recesses may be of a contrasting colour to the rest of the ball. This wear indicator acts as a safety feature by indicating to a user when it is time to change the ball.

The device may include a protective mat which underlies the base of the device, to which the base is fixed. The device is preferably a stand-alone unit, which may be used in any location as desired by the user without the need for additional securing means.

BRIEF DESCRIPTION OF THE DRAWINGS

Embodiments of the invention are now described, by way of example only, with reference to the following drawings in which:

FIG. 2(*b*) is a cross-sectional view along the line A—A of part of an optical wheel shown in FIG. 2 (*a*);

DETAILED DESCRIPTION OF THE PREFERRED EMBODIMENTS

Figure 1:
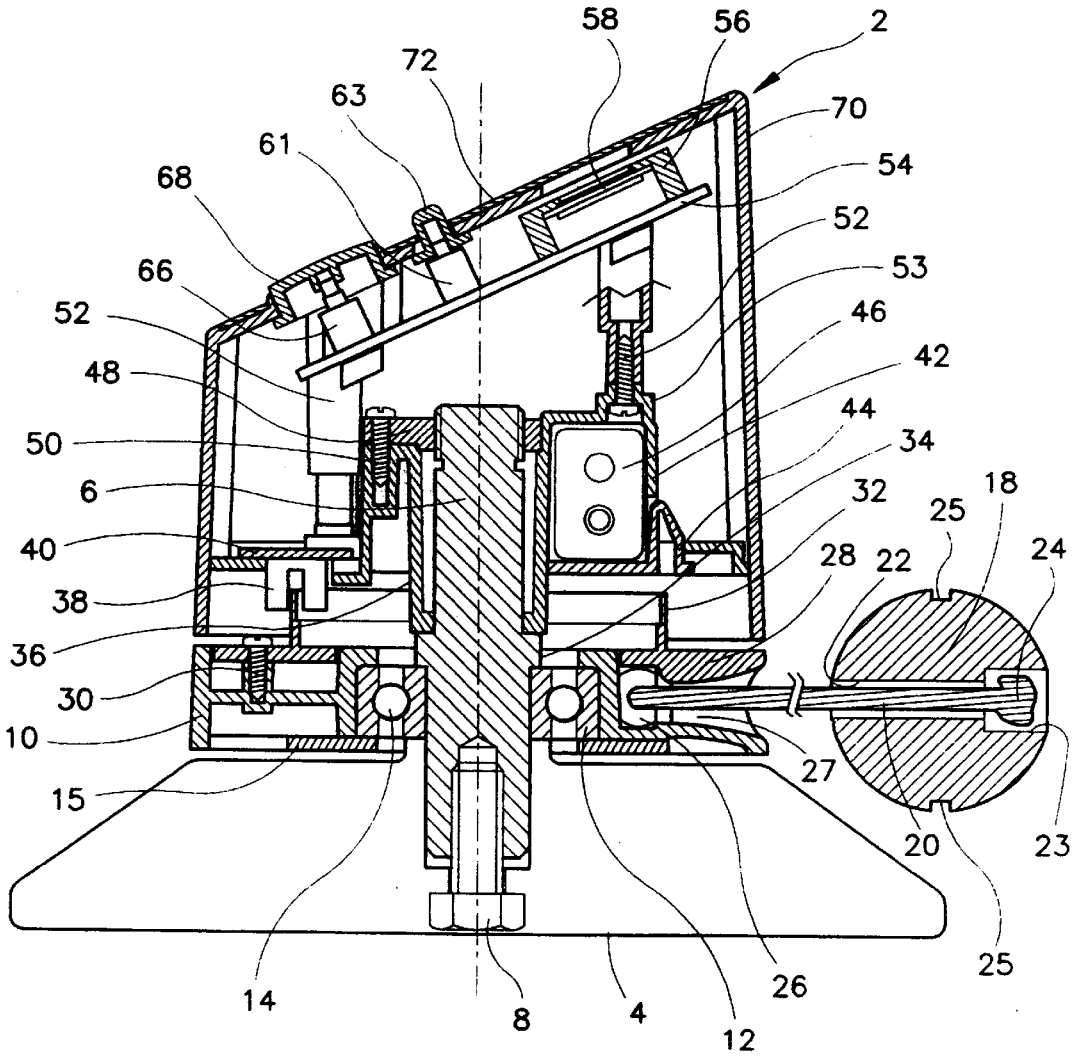
FIG. 1 is a cross-sectional view of the golf practice device according to the first embodiment of the invention.
Figure 2:
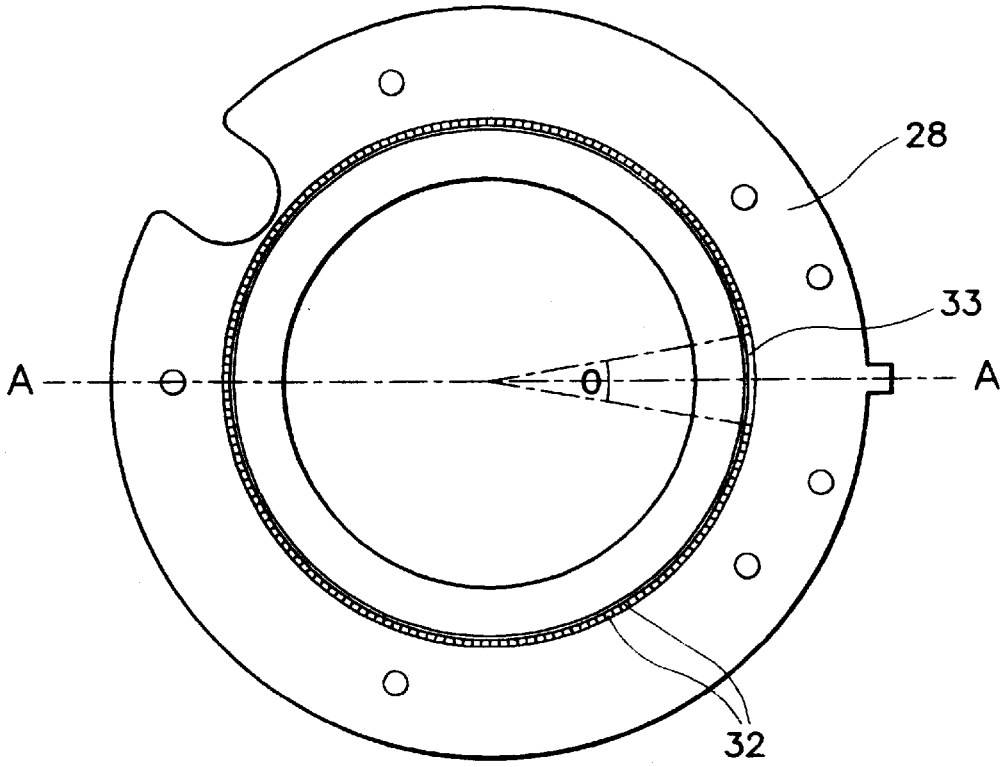
FIG. 2(*a*) is a view from above of a part of an optical wheel of the device shown in FIG. 1.
Figure 2:
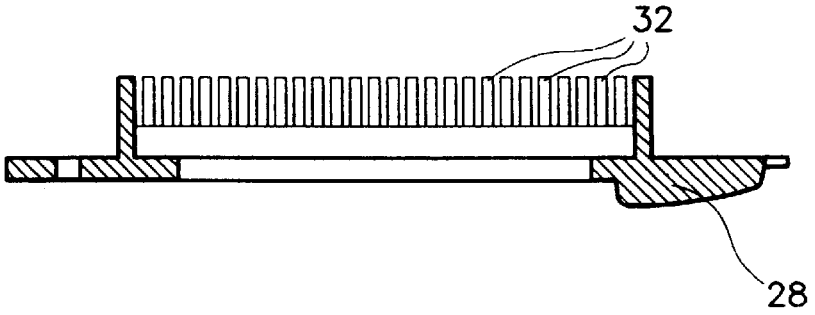

FIG. 1 is a cross-sectional view through the golf practice device in accordance with the first embodiment of the invention, and in which the device is indicated generally by reference numeral 2. The device includes a generally frustoconical ring-like base 4. The base 4 supports a central fixed shaft 6 a lower end of which extends into a central well formed in the base 4. The shaft 6 is provided with a central threaded bore at its lowest end into which a nut 8 extends to thereby removably fix the shaft 6 to the base 4. The shaft 6 is preferably formed of metal, but a plastics shaft may also be used. A wheel 10 is rotatably supported on the shaft 6 through a rolling bearing 12, which is a conventional ball bearing including a plurality of steel balls 14. At its lower face the wheel 10 is provided with a bearing cover ring 15 which is connected to the wheel 10 by means of a pair of screws 16 (see FIG. 3), thereby serving to clamp the wheel 10 onto the bearing 12.

Figure 6:
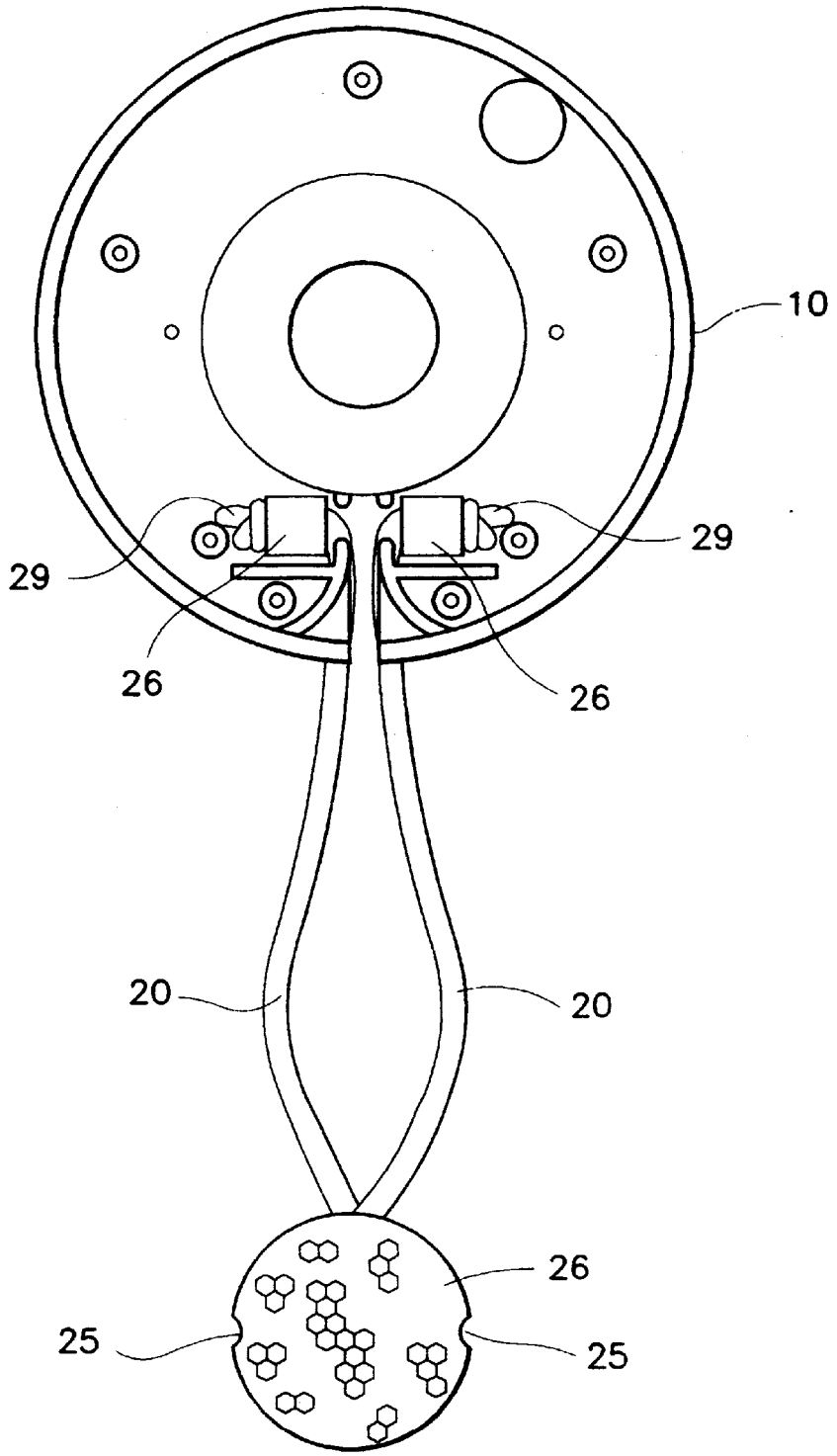
FIG. 6 is a view of the wheel (with optical ring removed) showing the connection of a ball thereto.

A simulated golf ball 18 is connected to wheel 10 through a pair of cords 20 of substantially identical length. Both cords 20 pass through a bore 22 which extends through the ball 18 to an enlarged recess 23 at which the cords are provided with knots 24. The opposite ends of the cords 20 are provided with tubular fixings 26 through which the cords extend and which sit in respective recesses formed in the wheel 10, as best seen in FIG. 6. Both the knots 24 and 29 are coated in plastics material such as epoxy resin to prevent movement and possible loosening or untying of the knots. The bore 22 and recess 23 of the ball are also filled with plastics material such as an epoxy resin after assembly. The wheel 10 is formed with a vertically elongate aperture 27 through which the cords 20 extend in a radial direction with respect to the shaft 6. The golf ball 18 may be formed of a variety of materials, but can be advantageously formed of a solid sphere of polyurethane. A ball of this material can have a weight and dimension closely approximating a real golf ball. Moreover, a solid polyurethane ball has been found to mimic closely the characteristics of a real golf ball in terms of feel on impact, giving the familiar "click" and "feel" of a real ball. A material with a hardness value of 95A has been found to be particularly appropriate.

As can be seen in FIG. 1, the ball 18 includes on opposite sides a pair of shallow generally cylindrical recesses or depressions 25, typically 1–2 mm deep, although they may be deeper than this. These are arranged on the vertically spaced sides of the ball. As the ball wears due to repeated impact with a protective mat or with the ground the depth of the recesses 25 will reduce, allowing a user to see clearly the progressive wear of the ball. The bottom or inner surface of the recesses may be coated with a contrasting colour to the rest of the ball to make it even easier to follow the wear. Once the recess has either disappeared or decreased in depth by a certain degree (as may be indicated by use of different colours) the user knows it is time to change the ball. At the same time the cords 20 and fixings 26 will be replaced. This ensures the safety of the device.

An optical ring 28 is mounted on an upper face of the wheel 10 by means of screws 30. The optical wheel 28 carries a large number of upwardly extending fingers 32 which form part of the arrangement for detecting the velocity of the golf ball, as will be described in further detail below.

An upper part of the shaft 6 supports a housing which carries an optical sensor, associated electronics, a battery, and a display device as is now described. The shaft 6 is provided approximately halfway along its length with a collar 34 on top of which sits a lower housing part 36. Near a left side of the device as shown in FIG. 1, on the lower housing part 36 there is mounted an optical sensor 38 which is carried on an optical sensor circuit board 40. The optical sensor 38 includes a U-shaped element having opposed arms which lie on opposite sides of the fingers 32 of the optical ring 28 and which respectively carry an aligned photodetector and photoemitter. A variety of proprietary sensors are available. An infra-red type sensor is preferably used. As the wheel 10 rotates the fingers 32 interrupt the optical beam resulting in the output from the sensor of a sequence of pulses, the frequency of which is proportional to the rotational velocity of the wheel 10. One region 33 of the optical ring 28 is provided with a solid arcuate portion. As this region, which extends over an angle of about 10°, moves between the photoemitter and detector no pulsed optical signal is generated. When the ball 18 is placed in position to be driven, the wheel 10 is positioned so that the region 33 lies within the sensor 38. This arrangement ensures that as the ball is struck and starts to move, over the period of acceleration of the ball whilst the ball is in contact with the club head, no measurement of velocity is being effected. Recording of pulses commences as the fingers 32 are reached, at which point the ball is already at or near its maximum velocity.

The lower housing part 36 also defines a battery housing 42 having a battery housing door 44 and enclosing a 9 volt battery 46. An upper region of the shaft 6 is provided with a thread which is engaged by a fixing nut 48 which is itself connected to the lower housing part 36 by means of screws 50.

A tubular housing 70 fits over the lower housing part 36 making a tight fit therewith. A pair of printed circuit boards 54 are supported on the housing 70 Pillars 52 depend from the cover 70 and are connected to corresponding upstanding pillars 53 upstanding from the lower housing part 36. The circuit boards 54 carry the electronic components necessary in order to process the pulsed signals received from the optical sensor 38 representative of velocity into an output representative of the distance which a real free golf ball would have travelled if subjected to the same impact as received by the golf ball 18 of the device, and to display this distance. A microprocessor or central processing unit is utilised including a memory in which is stored look-up tables of distance values associated with each velocity (or rather frequency or number of sensor pulses for a given period), or alternatively employing a stored algorithm yielding a distance value on input of a number of pulses. In the case of look-up tables, appropriate tables will be provided for each club weight, or rather group of club numbers as discussed below. The printed circuit board 54 also supports a liquid crystal display housing 56 which carries a liquid crystal display (LCD) 58. A pair of slide switches 60, 61 and buttons 62, 63 respectively and a push button switch 66 having a button 68 are also provided as discussed further below.

Figure 7:
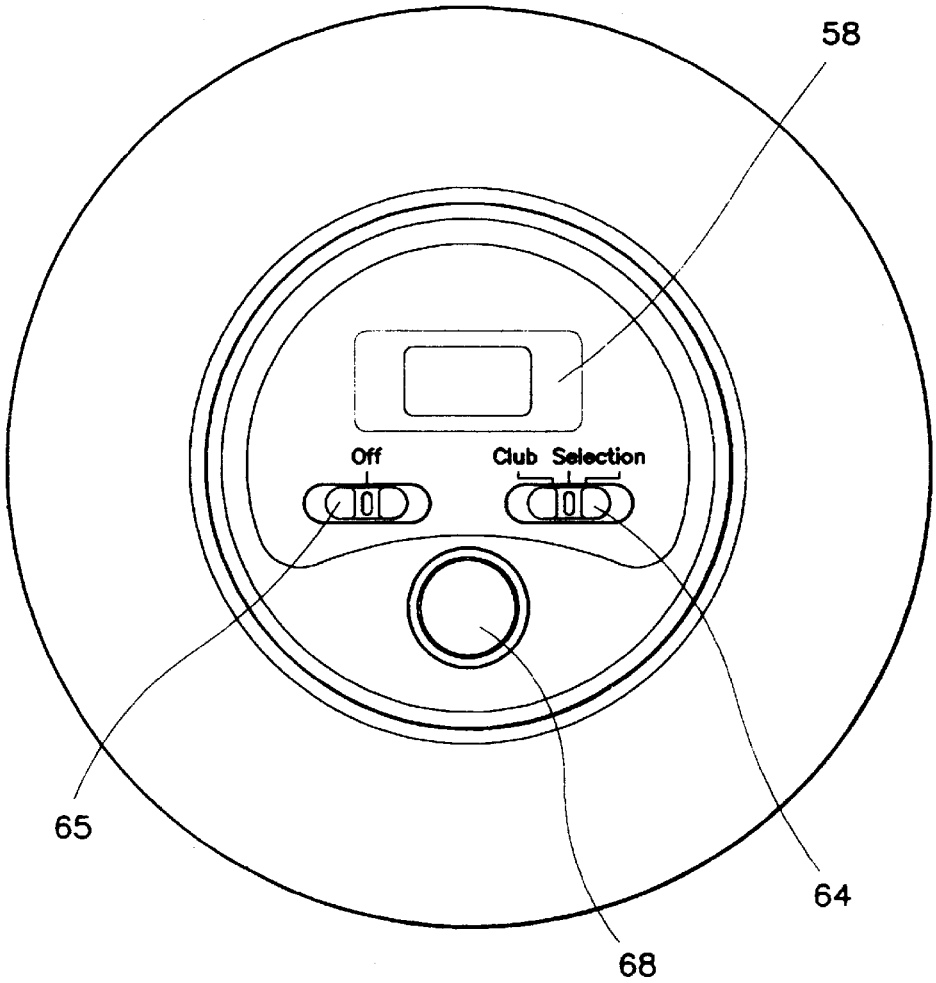
FIG. 7 is a view of the device from above showing the controls thereof.

A face plate 72 fits on the upper region of the housing and is provided with a clear region which overlies the LCD 58 and with apertures through which the buttons 64, 65 and 68 protrude. This plate 72 carries the markings as shown in FIG. 7.

In use, the golfer activates the device by moving the switch 65 from a central off position to either a manual (left-hand) or automatic (right-hand) position. The golfer selects the appropriate club number which he is using by means of the club selection switch 64, a left hand position for club numbers 1, 2 and 3, a central position for 4, 5, 6 and a right-hand position for 7, 8 and 9. As the ball 18 is struck the ring 10 rotates about the shaft 6, the optical sensor 38 giving a pulsed signal the frequency of which is proportional to the rotational velocity of the wheel 10. The processor determines a "velocity" by determining the number of pulses which have been detected by the sensor in a predetermined sensing time, typically 10 milliseconds. This velocity is equated to the true distance a real golf ball would have travelled if struck by that club, and outputting the distance on the LCD. In the manual mode the device can then be reset by pressing the reset button 68 in readiness for a further golf drive. In the automatic mode the resetting occurs automatically after a short predetermined delay.

Figure 3:
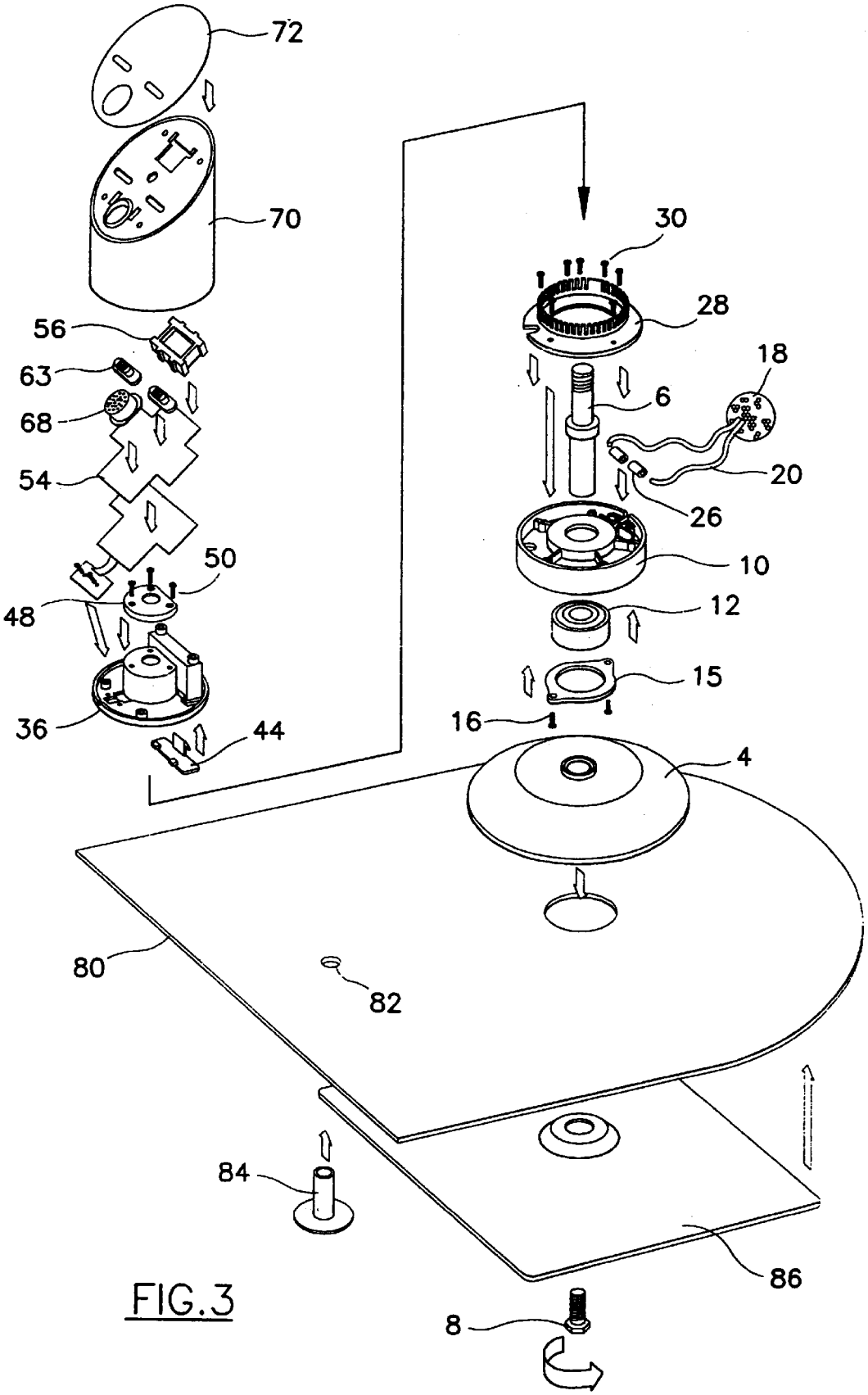
FIG. 3 is an exploded view of the golf practice device.

In order to protect the surface on which the device is placed a driving mat 80 of rubber-like material may be provided as shown in FIG. 3. This is provided with an aperture 82 through which protrudes a rubber tee 84. An underplate 86 preferably of metal is provided below the mat 80 having a central aperture dimensioned so that the shaft of bolt 8 can extend there through, the plate 86 serving to clamp the mat 80 to the base 4.

Figure 4:
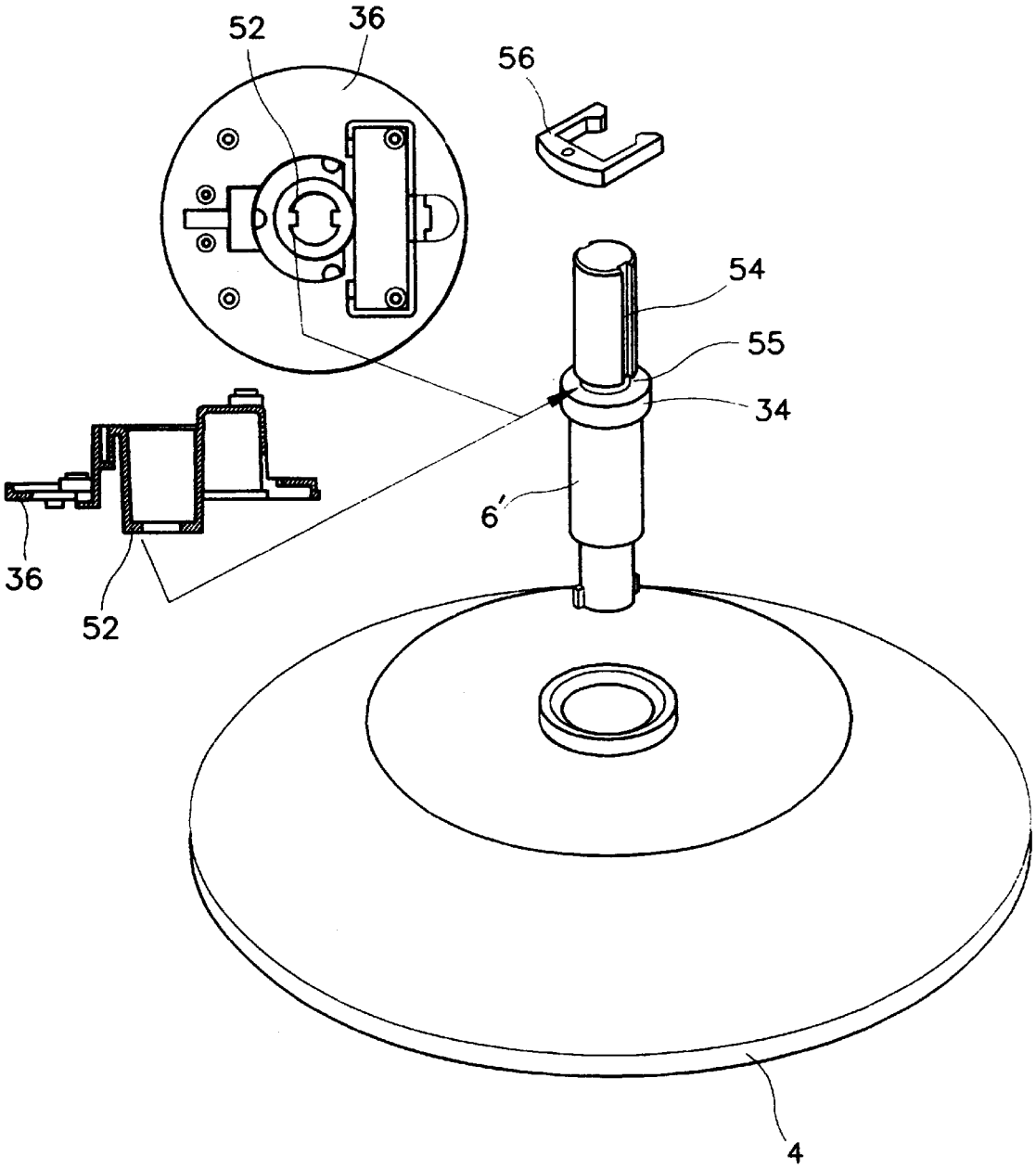
FIG. 4 shows the arrangement of a base and a central shaft of a golf practice device in accordance with a second embodiment of the invention.
Figure 5:
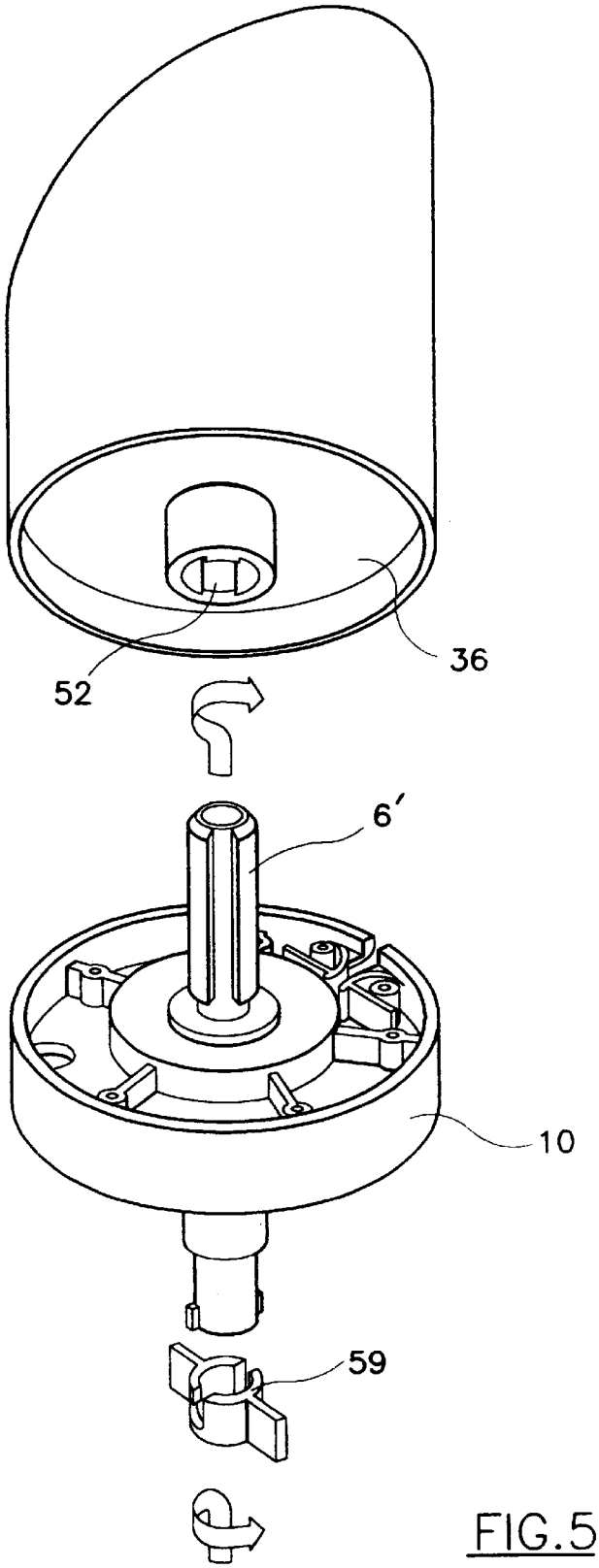
FIG. 5 illustrates the method of connection of a lower housing part to an upper housing part of the device in accordance with a second embodiment of the invention.

In an alternative arrangement shown in FIGS. 4 and 5, the shaft 6' is not formed of metal, but is formed of a plastics material, and alternative means of securing the shaft 6' to the housing and base are provided. The upper half of the shaft 6' is provided with opposed longitudinally extending grooves 54 and a neck 55. The central aperture in the lower housing part 36 is provided with a pair of inwardly extending lugs 52 which engage in the grooves 54. Instead of providing a nut (48 in the first embodiment), a clip 56 formed of a slightly resilient material is fixed to the lower housing part 36. On assembly, the housing is fitted onto the shaft 6 so that the lugs 52 engage in the grooves 54, the housing being pushed downwardly until the lugs 52 reach the neck 55 at which point the housing can be rotated. On rotation through 90° the opposed arms 58 snap-fit into the grooves 54 to lock the lower housing part 36 onto the shaft 6' and in the correct relative orientation. At its lower end, the shaft 6' is provided with a locking nut 59 which serves to releasably lock the base 4 to the shaft 6'.

As will be appreciated from the above description, the device is a stand-alone unit which can be used in any location where the user has room to swing a golf club. The wide base and low centre of gravity means that no additional securing means, such as pegs or stays, are required. The device may be used for either left or right-hand swings without modification. The device gives both realistic feel and accurate measurement of distance which a real free ball would have travelled.

We claim:

1. A golf practice device comprising:

a base supporting a substantially vertical fixed shaft;

a wheel mounted for rotation about the shaft;

a ball tethered by at least one flexible cord to the wheel;

sensing means disposed adjacent the wheel to detect the rotation thereof and output a signal representative of the rotation;

processing means adapted to process said signal and to output a signal representative of a free distance of travel of the ball; and display means to display said distance to a user.

2. A golf practice device according to claim 1 wherein the wheel is mounted on the shaft by means of a rolling bearing.

3. A golf practice device according to claim 1 wherein the ball is tethered to the wheel by means of a pair of cords.

4. A golf practice device according to claim 3 wherein the cords are of substantially identical length.

5. A golf practice device according to claim 1 wherein the wheel includes a photointerrupter in the form of a ring comprising a large number of upstanding generally axially-extending fingers, said sensing means comprising an opposed photo-transmitter and receiver arranged one inside and one outside the ring.

6. A golf practice device according to claim 5 wherein said ring is provided with a solid fingerless arcuate region, over which region no signals are generated by said sensing means as this region moves through the sensing means.

7. A golf practice device according to claim 6 wherein said arcuate region extends through an angle of about 10 degrees.

8. A golf practice device according to claim 1 wherein the ball is a solid sphere of polyurethane.

9. A golf practice device according to claim 1 wherein the golf ball includes at least one wear indicator in the form of a recess in the surface of the ball.

10. A golf practice device according to claim 9 wherein the or each recess is of a contrasting colour to the rest of the ball.

11. A golf practice device according to claim 1 further comprising a protective mat which underlies the base of the device, to which the base is fixed.

12. A golf practice device according to claim 1 wherein the device is a stand-alone unit.

* * * * *